US008465302B2

(12) United States Patent
Regnier et al.

(10) Patent No.: US 8,465,302 B2
(45) Date of Patent: Jun. 18, 2013

(54) CONNECTOR WITH IMPEDANCE TUNED TERMINAL ARRANGEMENT

(75) Inventors: Kent E. Regnier, Lombard, IL (US); Harold Keith Lang, Cary, IL (US)

(73) Assignee: Molex Incorporated, Lisle, IL (US)

( * ) Notice: Subject to any disclaimer, the term of this patent is extended or adjusted under 35 U.S.C. 154(b) by 206 days.

(21) Appl. No.: 13/062,984

(22) PCT Filed: Sep. 9, 2009

(86) PCT No.: PCT/US2009/056303

§ 371 (c)(1), (2), (4) Date: May 19, 2011

(87) PCT Pub. No.: WO2010/030622

PCT Pub. Date: Mar. 18, 2010

(65) Prior Publication Data

US 2011/0212633 A1 Sep. 1, 2011

Related U.S. Application Data

(60) Provisional application No. 61/095,450, filed on Sep. 9, 2008, provisional application No. 61/110,748, filed on Nov. 3, 2008, provisional application No. 61/117,470, filed on Nov. 24, 2008, provisional application No. 61/153,579, filed on Feb. 18, 2009, provisional application No. 61/170,956, filed on Apr. 20, 2009, provisional application No. 61/171,066, filed on Apr. 20, 2009, provisional application No. 61/171,037, filed on Apr. 20, 2009.

(51) Int. Cl.
*H01R 4/66* (2006.01)

(52) U.S. Cl.
USPC ..... 439/108; 439/607.05; 439/607.08; 439/607.39

(58) Field of Classification Search
USPC ..... 439/108, 101, 607.05, 607.08–607.09, 439/607.11, 607.14, 607.39, 607.56
See application file for complete search history.

(56) References Cited

U.S. PATENT DOCUMENTS

| | | | | |
|---|---|---|---|---|
| 6,293,827 | B1 | 9/2001 | Stokoe | |
| 6,384,341 | B1 * | 5/2002 | Rothermel et al. | 174/255 |
| 6,913,490 | B2 * | 7/2005 | Whiteman et al. | 439/607.05 |
| 7,278,886 | B2 | 10/2007 | Cohen et al. | |
| 7,534,142 | B2 * | 5/2009 | Avery et al. | 439/607.05 |
| 7,824,197 | B1 * | 11/2010 | Westman et al. | 439/108 |
| 7,993,147 | B2 * | 8/2011 | Cole et al. | 439/79 |
| 8,215,968 | B2 * | 7/2012 | Cartier et al. | 439/83 |
| 8,226,441 | B2 * | 7/2012 | Regnier et al. | 439/626 |
| 8,267,721 | B2 * | 9/2012 | Minich | 439/607.05 |
| 2006/0068641 | A1 | 3/2006 | Hull et al. | |

* cited by examiner

*Primary Examiner* — Xuong Chung Trans
(74) *Attorney, Agent, or Firm* — Stephen L. Sheldon

(57) ABSTRACT

A connector housing includes a plurality of wafers containing terminal dedicated to either ground signals or differential signals. Terminals in adjacent wafers can be arranged to provide broadside coupled differential signal pairs. Terminals dedicated for use as ground terminals can be wider than the signal terminals to provide shielding between adjacent differential signal pairs. The signal terminals of each differential signal terminal pair can a constant width from their contact portions to a location proximate their tail portions and the terminals diverge from broadside alignment and increase in their width until they end at the terminal tail portions.

22 Claims, 15 Drawing Sheets

CONNECTOR WITH IMPEDANCE TUNED TERMINAL ARRANGEMENT

REFERENCE TO RELATED APPLICATIONS

This application is a national phase of international application PCT/US09/56303, filed Sep. 9, 2009 and claims priority to U.S. Provisional Appln. No. 61/095,450, filed Sep. 9, 2008; to Appln. No. 61/110,748, filed Nov. 3, 2008; to Appln. No. 61/117,470, filed Nov. 24, 2008; to Appln. No. 61/153,579, filed Feb. 18, 2009, to Appln. No. 61/170,956 filed Apr. 20, 2009, to Appln. No. 61/171,037, filed Apr. 20, 2009 and to Appln. No. 61/171,066, filed Apr. 20, 2009, all of which are incorporated herein by reference in their entirety. This application was filed concurrently with the following application, which is not admitted as prior art to this application and which is incorporated herein by reference in its entirety:

Application Serial No. PCT/US09/56321, entitled FLEXIBLE USE CONNECTOR, and which during national phase became U.S. patent application Ser. No. 13/063,010, filed Mar. 9, 2011.

BACKGROUND OF THE INVENTION

The present invention generally relates to connectors suitable for transmitting data, more specifically to input/output (I/O) connectors with improved electrical performance.

There is an ongoing effort in the telecommunications field to increase performance, while reducing the size of connectors used in the field. For I/O connectors used in data communication, these efforts create somewhat of a problem. Using higher frequencies (for increased data rates) requires reliable electrical separation between signal terminals in a connector that minimizes cross-talk. However, reducing the size of the connector and making the terminal arrangement more dense, brings the terminals closer together, which typically results in a decrease in electrical separation.

There is also a desire to improve manufacturing. For example, as signaling frequencies increase, the tolerance of locations of terminals, as well as their physical characteristics become more important in that they influence the operation of the connector. Therefore, certain individuals would appreciate improvements to a connector design that would facilitate manufacturing while still providing a dense, high-performance connector.

SUMMARY OF THE INVENTION

A connector assembly includes a hollow housing supports a plurality of wafers. Each wafer includes an insulative frame that supports multiple terminals. Each terminal includes a tail portion positioned along a mounting face of the connector and a contact portion positioned at a mating face of the connector and a body portion therebetween. The mounting and mating faces can be arranged so that they are at right angles to each other. The mating face can include two card-receiving slots. The wafers can be configured to provide either ground terminals or signal terminals and the wafers can be arranged in a predetermined pattern. For example, wafers can be configured so that there is one ground wafer and two signal wafers and each wafer has a different exterior shape and can only be inserted into the housing in particular locations. Wafers supporting signal terminals are configured so that the signal terminals in adjacent wafers can be broadside coupled together. A wafer supporting ground terminals can be positioned between two pair of wafers that support broadside coupled signal terminals and body portions of the ground terminals can be wider than body portions of the signal terminals. In an embodiment, the signal terminals that form a broadside coupled pair are kept a consistent distance apart through the body portion but have tails that diverge away from each other. To help reduce impedance changes through the tail portion, the tail portions can be wider. The tails portions diverge away from each other in a symmetric manner.

BRIEF DESCRIPTION OF THE DRAWINGS

Throughout the course of the following detailed description, reference will be made to the drawings in which like reference numbers identify like parts and in which.

DETAILED DESCRIPTION OF THE ILLUSTRATED EMBODIMENTS

As required, detailed embodiments are disclosed herein; however, it is to be understood that the disclosed embodiments are merely exemplary. Therefore, specific details disclosed herein are not to be interpreted as limiting, but merely as a basis for the claims and as a representative basis for teaching one skilled in the art to variously employ the disclosure in virtually any appropriate manner, including employing various features disclosed herein in combinations that might not be explicitly disclosed herein.

Figure 1:
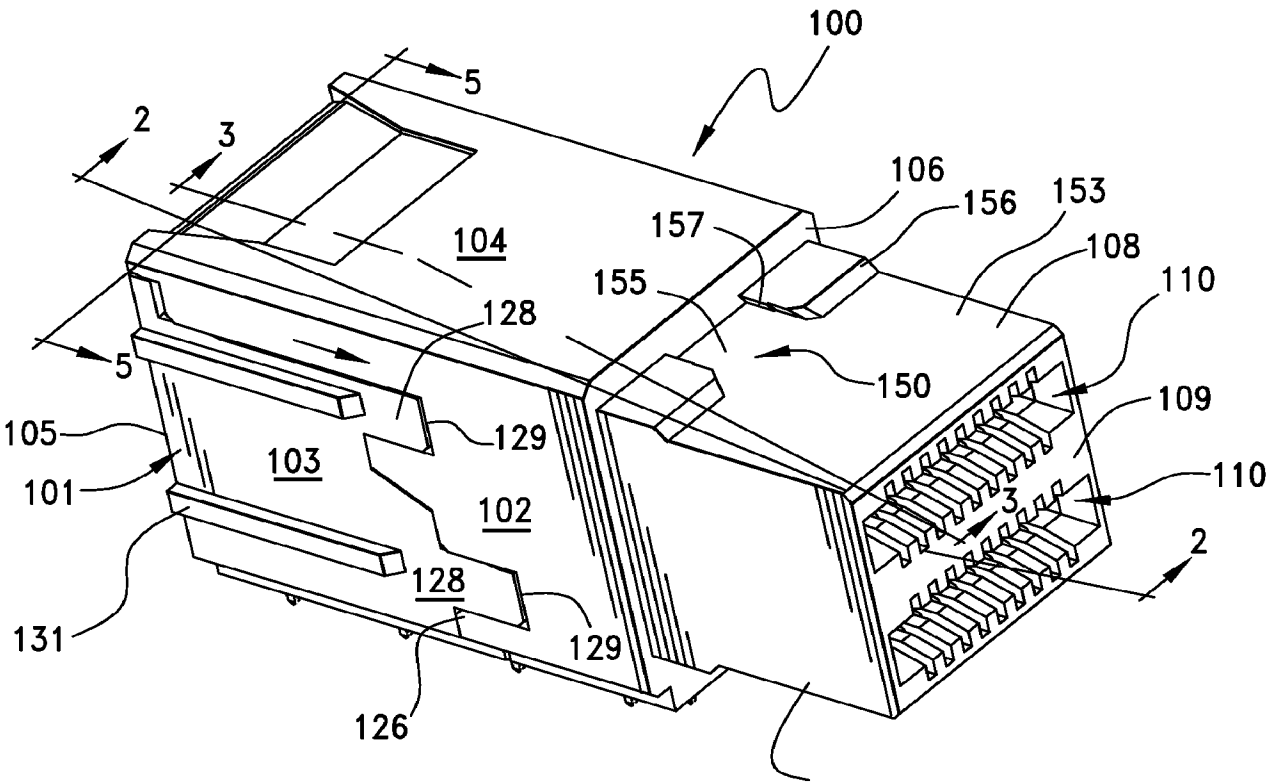
FIG. 1 illustrates a perspective view of an embodiment of a connector.

FIG. 1 illustrates a connector 100. The connector 100 includes a housing 101, which may be formed of a insulative material and is illustrated as having two interengaging first and second (or front and rear) pieces, or parts, 102, 103. The housing 101, as shown in FIG. 1, has a wide body portion 104 that extends between a rear face 105 and the front face 106. A mating portion 107 that takes the form of an elongated nose portion 108 projects forwardly of the front face 106 and terminates in a front mating face 109. The mating face 109 may have one or more circuit card-receiving slots 110 which are formed widthwise in the mating face 109, with two such slots 110 being shown in FIG. 1.

Figure 2:
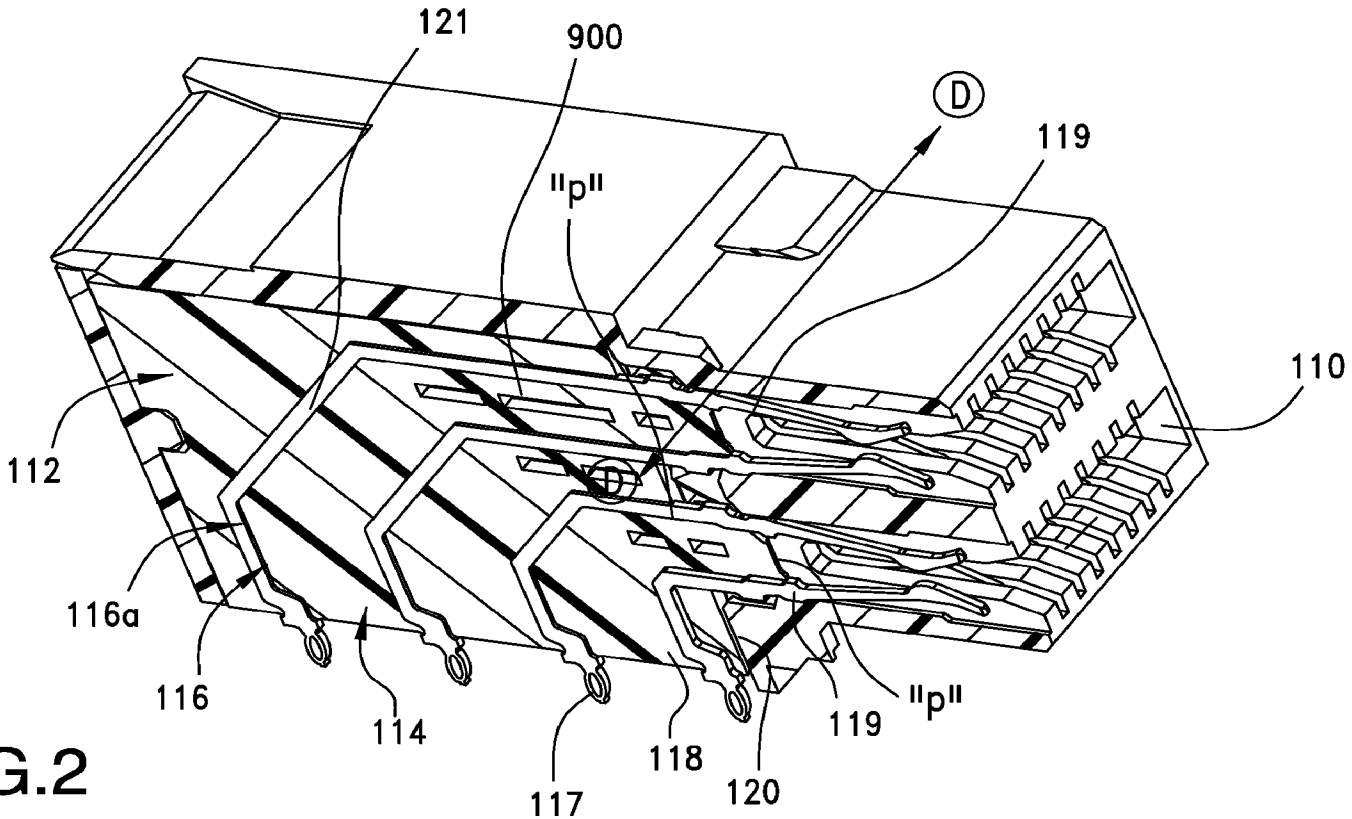
FIG. 2 illustrates a sectional view of the connector depicted in FIG. 1, taken along lines 2-2 thereof.
Figure 3:
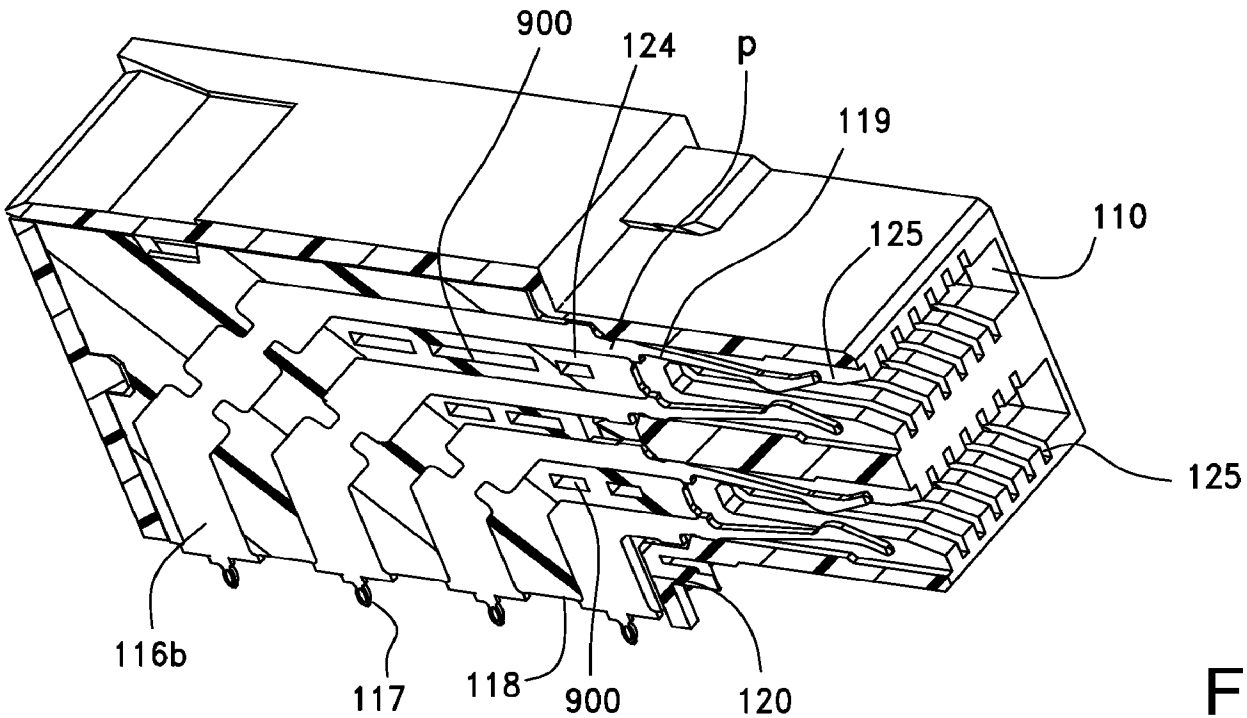
FIG. 3 illustrates a sectional view of the connector depicted in FIG. 1, taken along lines 3-3 thereof.
Figure 4:
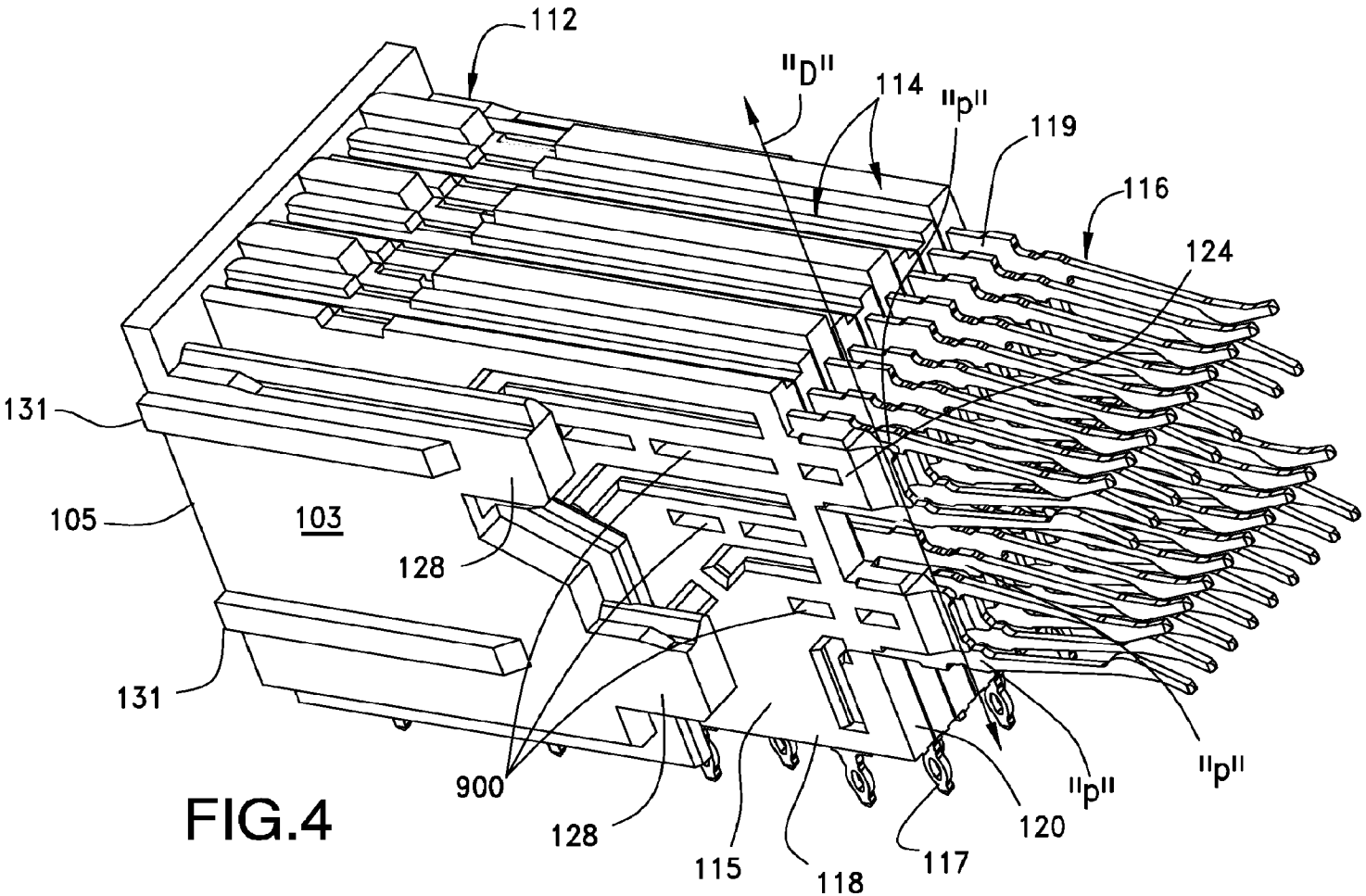
FIG. 4 illustrates a perspective view of the connector depicted in FIG. 1, with the housing front portion removed to show the internal terminal assemblies.

As shown in FIGS. 2-3, the housing 101 has a hollow interior portion 112 that receives a plurality of individual terminal assemblies 114 that take the form of a wafer 115. Each such wafer 115 contains a plurality of conductive terminals 116, and each such terminal includes tail portions 117 projecting out from a first edge 118 and contact portions 119 projecting from a second edge 120 of the wafer 115. In the illustrated embodiment, the two edges 118, 120 are adjacent each other and at a right angle to each other. The first edge 118 of the terminal assemblies 114 serves as a mounting face for the block of terminal assemblies shown in FIG. 4. The second edge 120 serves as a mating face for the terminal assemblies 120. The terminals 116 further include body portions 121 that interconnect the tail portion 117 and contact portions 119 together. The wafer 115 may have openings 123 formed therein in the form of slots that extend along the terminal body portions 121 to expose them to air and thereby affect the terminal impedance.

The terminal assemblies 114 are held together as a block within the housing 101 in a manner such that the terminal tail portions 117 extend out through the bottom of the housing 101 and the terminal contact portions 119 extend from the edges 120 of their wafers 115 into the housing nose portion 108. The terminal contact portions 119 are arranged in the wafers 115 as pairs of terminals and these pairs are located on the upper and lower sides of the card-receiving slots 110. (FIGS. 2 and 3.) As explained in greater detail below, the depicted terminals 116 are arranged in sets of ground terminals 116*b* or signal terminals 116*a* within a wafer, with certain wafers containing only ground terminals 116*b* and other wafers containing only signal terminals 116*a*. In an embodiment, two signal terminal-carrying wafers are arranged side-by-side such that they define pairs of signal terminals 116*a* which are broadside coupled. In this manner the terminals can transmit differential signals through the connector.

Figure 6:
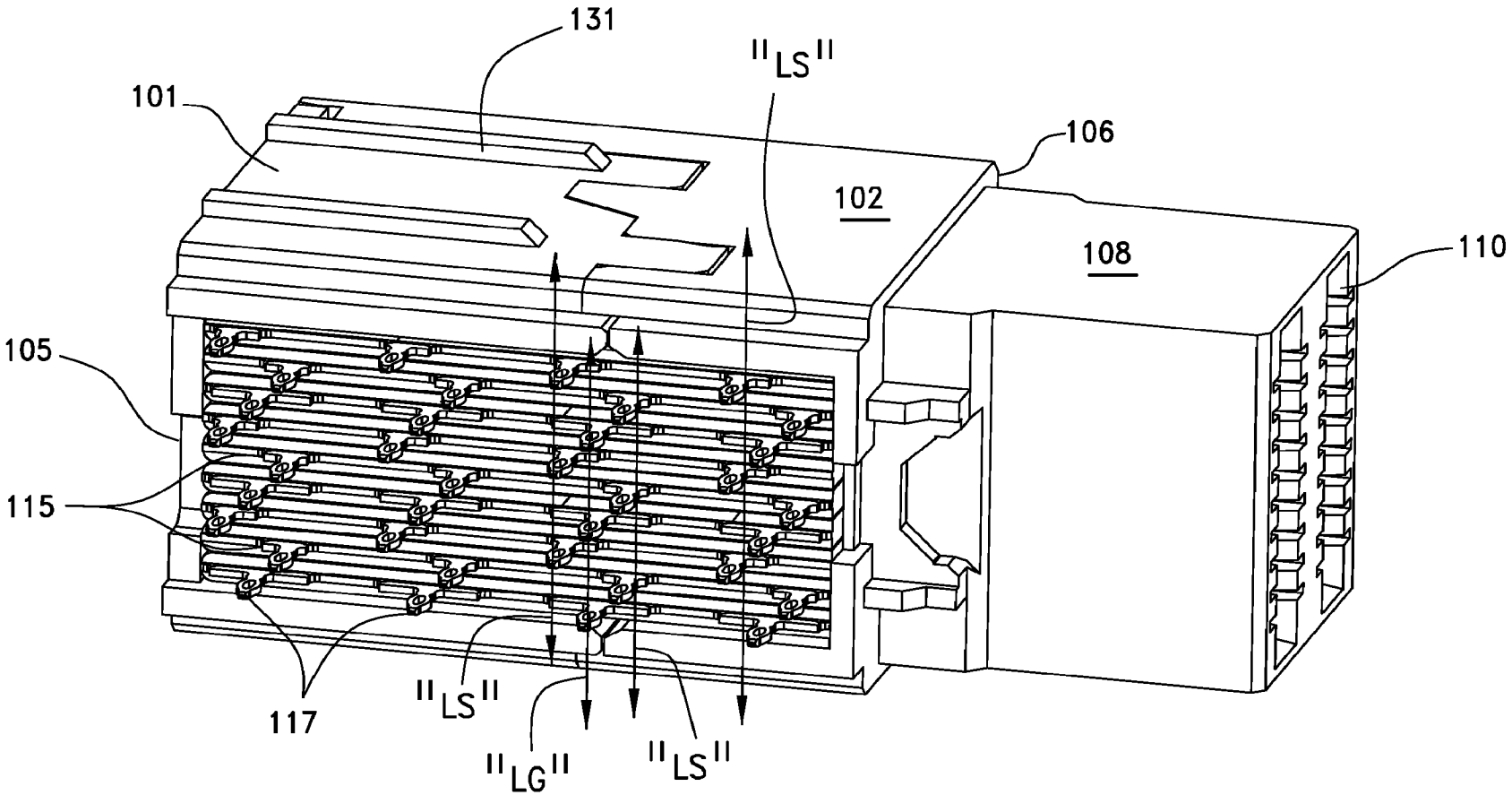
FIG. 6 illustrates a perspective view of an underside of the connector depicted in FIG. 1.

The terminals 116 are further provided as sets of thin signal terminals 116*a* as shown in FIG. 2, and wide ground terminals 116*b*, as shown in FIG. 3. All of the terminals 116, as noted above, project forwardly from the second edge 120 of the terminal assembly wafers 115 and selected portions 124 of the wafers 115 extend past the second edge 120. The selected portions 124 are provided to hold the terminal contact portions 119 in place within the forward nose portion and to move the point "P," around which the terminal contact portions deflect, into the nose portion 108 of the housing 101, as shown in FIG. 3. As shown in FIG. 6, the terminal tail portions 117 of each distinct set of wafers 115 are aligned laterally (widthwise) of the connector 100. That is, the ground terminal tail portions 117*b* are arranged on respective widthwise lines, or common axis, such as "LG" in FIG. 6. Likewise, the signal terminal tail portions 117*a* can also be arranged along their own coincident lines "LS". It can be seen that the two signal lines LS lie on opposite sides of the ground line LG.

As can be understood from the drawings, the contact portions 119 are cantilevered in their structure and act as contact beams that deflect away from the slots 110 when a circuit card is inserted therein. In order to accommodate this upward and downward deflection of the contact portions 119, the nose portion 108 of the housing 101 has terminal-receiving cavities 125 that extend from a vertical preselected above and below centerlines of each slot 110. Preferably, as will be explained more below, the ends of the selected portions 124 run along a line "D" that is close to, or most preferably, substantially coincident with the deflection points "P" (FIG. 2.). The connector 100 may be enclosed in a shielded, exterior housing, not shown, and as such, the height of the connector is restricted, not only to a height that will fit inside of an exterior housing, but also a height that accommodates the two edge, or paddle, cards of an opposing connector while allowing that opposing connector to be compactly designed.

Returning to FIGS. 1-4, the housing 101 has its two pieces 102, 103 mate along an irregular mating line 126 that extends upwardly through the sides of the housing 101 along a path that extends from front to rear of the housing 101. This irregular mating line facilitates the molding of the housings and it is explained in greater detail in U.S. Provisional Patent Application No. 61/122,102, filed Dec. 12, 2008 for "Two-Piece Thin Wall Housing." The two housing parts 102, 103 interlock together or engage with each other along this irregular and non-linear mating line 126. With this irregular configuration, a pair of rails 128 and channels 129 are defined in the two housing pieces 102, 103 with the rails 128 fitting into the channels 129. Outer ribs 131 may also be formed on the exterior side surfaces of the rear housing part 103 and these ribs 131 are preferably horizontally aligned with the rails 128 to provide reinforcement to the rails 128 and can also provide a means for positioning the connector subassembly 100 within an exterior housing or shield.

Figure 5:
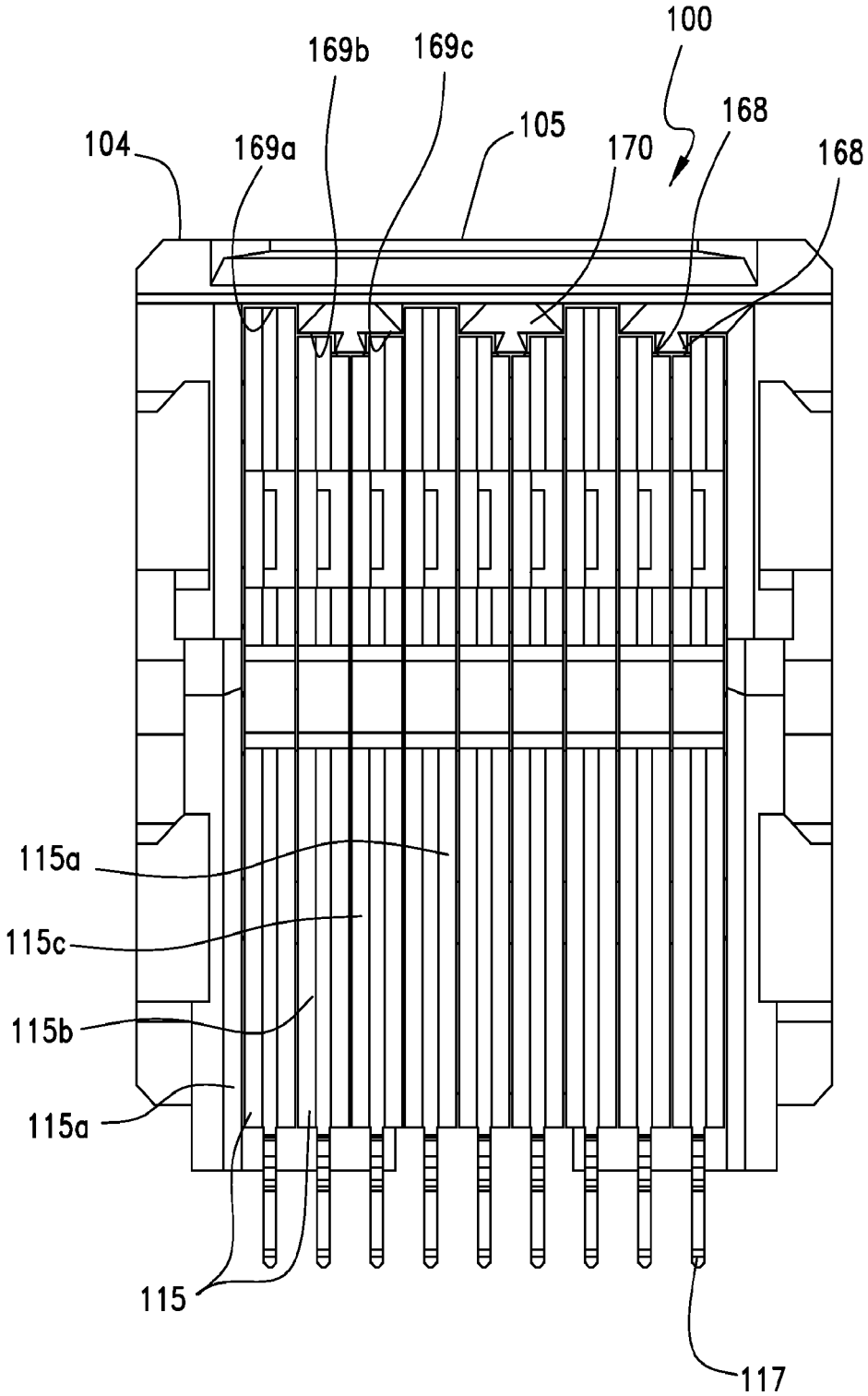
FIG. 5 illustrates a sectional view of the connector of FIG. 1, taken along lines 5-5 thereof.

FIG. 5 is a rear elevational view of the connector 100. The hollow interior is configured to provide different slots for the different ground and signal terminal assembly wafers. This configuration, while not required, can help prevent incorrect assembly of wafers in the connector. This configuration also permits the different types of wafers to be located and inserted as groups.

As depicted, the wafer at the leftmost edge of the interior of the housing 101 is a first wafer 115*a*. In order from the left, a second wafer 115*b* is beside the first wafer 115*a* and a third wafer 115*c* is beside the second wafer 115*b*. If the first wafer 115*a* is a ground wafer (it supports ground terminals) and the second and third terminal 115*b*, 115*c* are each a signal wafer (they support signal terminals), the depicted configuration supports a repeating pattern of ground, signal, signal wafers. This allows two terminals in adjacent signal wafers to form a differential pair that can be coupled together (as depicted, broadside coupled) as terminal pair while providing a ground wafer between the broadside coupled terminals. As can be appreciated, therefore, the connector can have a plurality of signal wafers that form pairs of coupled differential signal terminal and each pair of signal wafers is separated by a ground wafer. In an embodiment, broadside-coupled terminal pairs can be arranged in four rows of terminals, 140*a*, 140*b*, 140*c* and 140*d*. The differential signal terminal pairs in rows 140*a* and 140*c* engage contacts disposed on the upper surfaces of two edge cards of an opposing, mating connector (not shown), while the differential signal terminal pairs in rows 140*b* and 140*d* engage contacts disposed on the lower surfaces of the two edges cards.

As depicted, each wafer is polarized, or keyed, by virtue of its external configuration. The ground wafer 115*a* has a first height and as depicted is taller than the signal wafers 115*b*, 115*c*. Consequentially, the ground wafer 115*a* can only be inserted into the slots 169*a* disposed in the front half 102 of the housing 101. The second wafer 115*b* is configured with a step 168*b* with a first orientation that allows the second wafer

115*b* to mate with a slot 169*b* but does allow insertion into slot 169*c*. The third wafer 115*c* has a step 168*c* that allows it to be received in slot 169*c*.

Theses steps 168*b, c* that are formed in the signal terminal assembly wafers 115*b*, 115*c* engage two sides of projection member 170 of the housing 101. Other means of polarizing, or keying, the wafers 115 may be utilized, such as varying the height of the wafers 115 and the slots 169. In this manner, each distinct set of terminal assembly wafers may be loaded into the housing 101 as a group to facilitate assembly. One aspect that can be appreciated is that the three-wafer system can be stitched into the housing interior 112 without first combining two or more of the wafers 115 together, so that each set of wafers is fully stitchable. This has the benefit of providing a convenient manufacturing process. Importantly, due to the difference of heights and or steps, when the taller wafer is inserted first, the proper wafers can only be inserted into their predetermined slots, thus providing a high performance three-wafer construction while ensuring the wafers are installed properly.

It should be noted that while a poke-a-yoke type assembly configuration for a wafer has been determined to be desirable, it is not required. Furthermore, the additional height used for the wafers that support the ground terminals is also not required. One benefit of using the taller wafers for ground terminals is that the additional space makes it easier to use wider ground terminals. To provide the poke-a-yoke assembly configuration, however, one can also use wafers with other shapes, such as a V or inverted V shape that only allows those wafers to be inserted in the appropriate channels in the housing.

Figure 7:
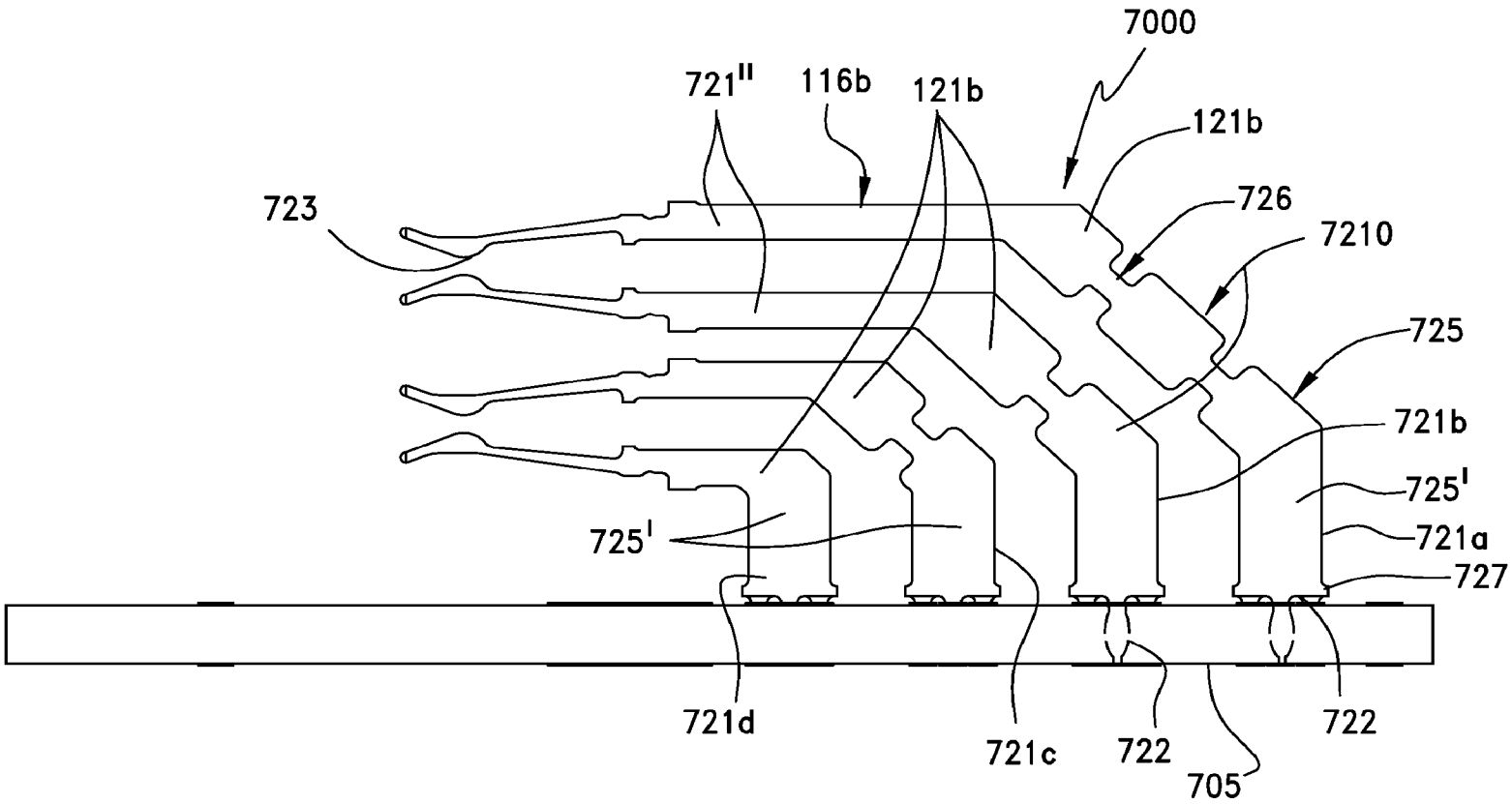
FIG. 7 illustrates an elevated side view of an embodiment of an array of ground terminals as may be supported within a ground wafer.
Figure 8:
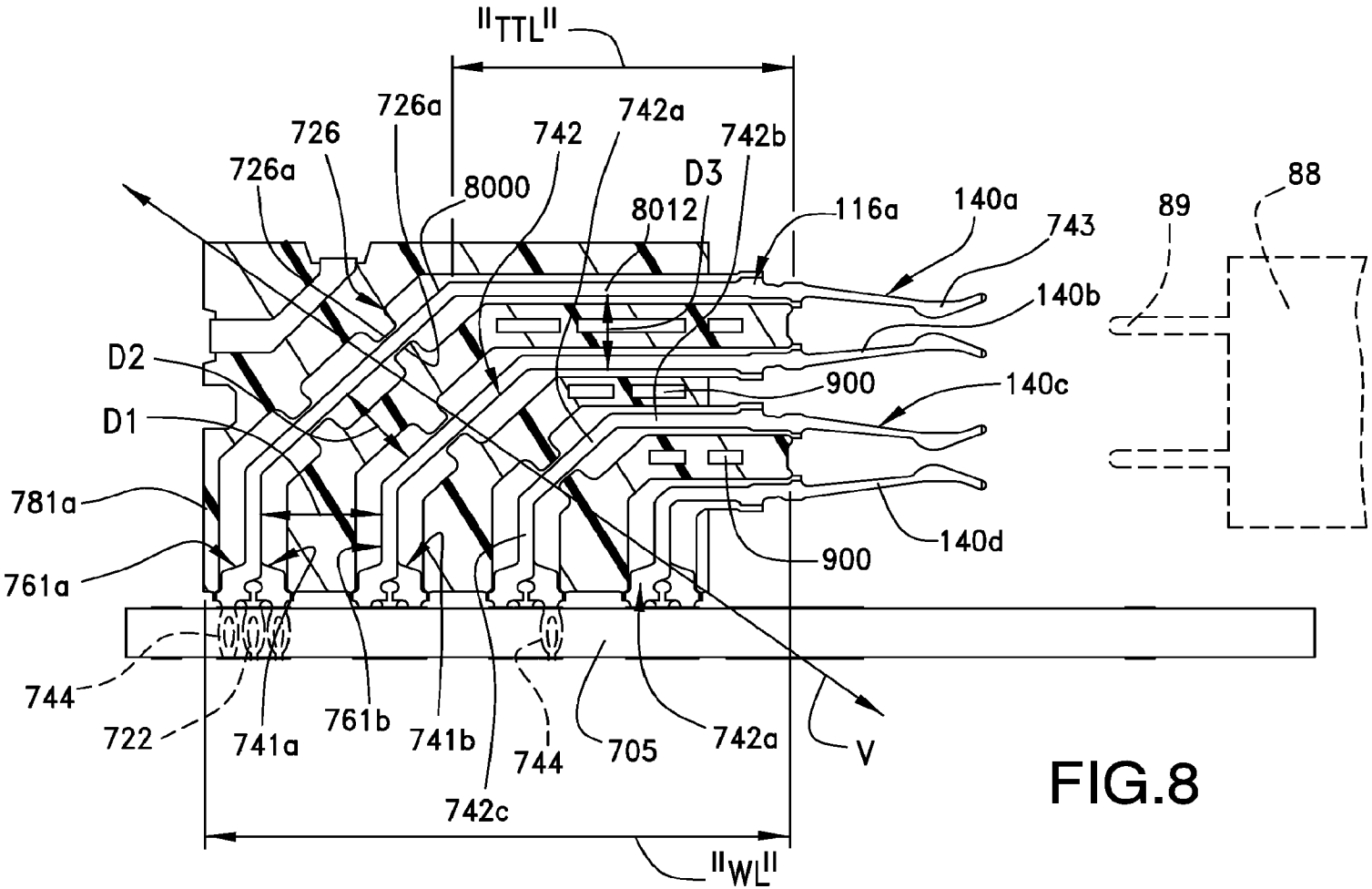
FIG. 8. illustrates a sectional view taken through a stack of terminal assemblies of the connector of FIG. 1 with the supporting frame of the wafer removed.
Figure 9:
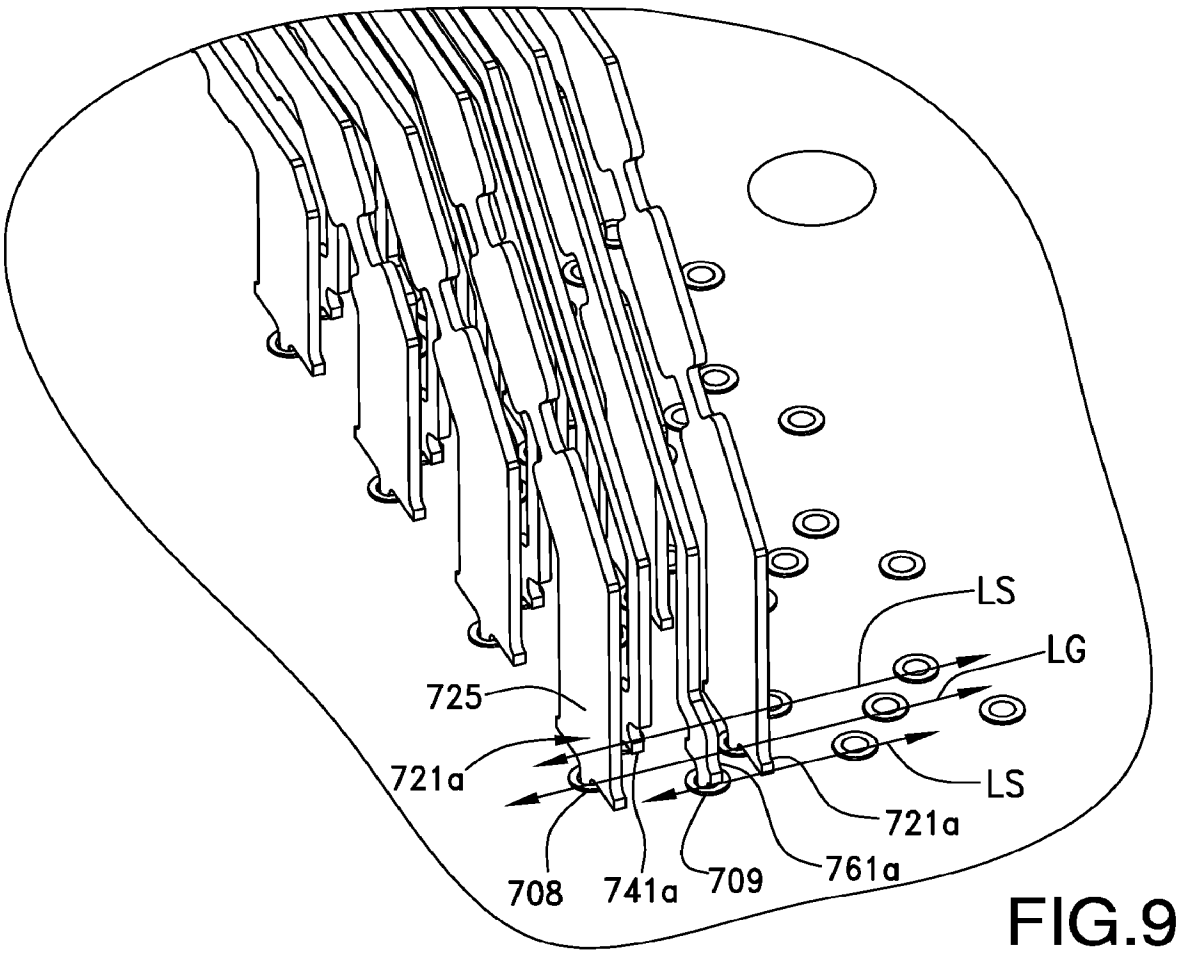
FIG. 9 illustrates a perspective detailed view of an embodiment of an array of broadside coupled signal terminals flanked by ground terminals.

FIG. 7 illustrates a ground terminal assembly 7000 removed from its supporting insert wafer frame, illustrating that ground terminals 7010 are significantly wider than their corresponding signal terminals. This difference is size occurs primarily in the width dimension of the ground terminals and FIG. 8 illustrates the size difference by showing a signal terminal assembly 8000, also removed from its supporting insert wafer frame. The signal terminals 116*a* of this assembly 8000 are illustrated in broadside alignment with a set of adjacent ground terminals 116*b*. The signal terminals have contact portions 743 that will engage the opposing surfaces of edge cards 89 of an opposing, mating connector 88 (FIG. 8), tail portions 722 that fit into vias 709 or other openings in a circuit board and body portions 8012 that connect the contact and tail portions together.

Four ground terminals 721*a-d* are illustrated in FIG. 7, and each ground terminal can be seen to have contact portions 723 at one end and tail portions 722 at opposing ends. The contact portions 723 and tail portions 722 are joined by intervening body portions 725 that extend therebetween. As shown, each of the ground terminal body portions includes a vertical component 725' extending to the tail portion 722 and a horizontal component 725" extending to the contact portion 723. Three of the terminals shown further include an angled component 7210, while the remaining ground terminal 721*d*, the one that is nearest to the intersection of the housing mating face and mounting face, has no such angled component.

In an embodiment, manufacturability of the connectors can be increased by the configuration of the ground terminals 116*b*. As shown best in FIGS. 7 and 8, some of the ground terminals 721*a-c* of each ground terminal insert wafer are provided with notches 726 that are formed in the edges of the ground terminal body portions 121*b*. These notches 726 are provided in sets of pairs of notches, with each notch 726 of each pair extending inwardly of the ground terminal from the opposing outer edges 725*a* of the terminal body portions. Preferably, the pairs of notches 726 are formed in the angled components 7210 of the terminal body portions 725, and not in either of the vertical or horizontal components 725', 725".

As shown in the Figures, the notches 726 of each pair of notches are aligned with each other so that their inner edges 726*a* confront each other. The notches 726 are formed in the terminal body portion angled components, where the ground terminal body portions are the widest. These notches 726 provide improved retention of the ground terminals 116*b* within each such ground terminal assembly wafer 115*a*. The notches 726 also facilitate the molding of the ground terminal assembly wafers 115*a* by providing additional, interconnected flowpaths for the molding material to traverse during the molding of the wafer 115*a* over the wide ground terminals 116*b*. In this regard, and as shown, the notches 726 of the ground terminals 116*b* are offset from any of the notches in any adjacent ground terminals. This type of alignment is preferred because the notches provide areas of strength where the molding material from which the ground terminal insert wafer is made may extend from one side of the wafer to the other side, through the plane of the ground terminal body portion notches. As shown in FIG. 8, three terminals 721*a-c* of the four ground terminals 116*b* of each ground terminal assembly wafer 115*b* have at least one pair of notches 726, but the lowermost ground terminal 721*d*, which has no significant body portion angled component 7210 has no notches. This lowermost (fourth) ground terminal 721*d* is the terminal that is nearest the intersection of the housing mating and mounting faces.

The ground terminals, as shown in FIG. 8, also have a narrow horizontal length where the ground terminals are reduced in their width, but still are wider than either of the two signal terminals adjacent thereto. This assists in reducing the overall height of the terminal assembly. This reduced height and reduced parallel length reduces the crosstalk over the length of the terminals even in the horizontal extents, and as they approach the contact portions the ground terminals are wider than their corresponding and adjacent signal terminals.

One issue with respect to electrical separation in a stacked connector is that electrical separation between horizontally arranged differential signal terminal pairs is relatively easy to attain in a compact area by using ground shields, or ground terminals that extend in vertical columns disposed between the differential signal terminal pairs. The ground terminals can couple with the adjacent signal pairs and helps limit any coupling between two adjacent differential pairs. However, maintaining electrical separation between horizontal rows of differential signal pairs can be more difficult to ensure. One method of doing so would be to include ground shields between the rows but this would be somewhat problematic because the small dimensions of the connector make it difficult to have additional terminals or shielding in the wafers, especially near the mating face of the connector. The difficulty in ensuring electrical separation between rows is increased in connectors with small height dimensions, such as the connectors depicted herein, and particularly if the connector system utilizes edge cards as a mating interface.

To address this issue, the depicted connector provides wafers where the signal terminals 116*a* are first separated by an edge-to-edge spacing of D1 between adjacent vertical components 742*c* of the signal terminal body portions 742. That spacing D1 is reduced by about 20% to an edge-to-edge spacing D2 between the angled components 742*a* of the signal terminal body portions 742, and that spacing D2 is again reduced by about another 20% to an edge-to-edge spacing D3 between the horizontal components 742*b* of the signal terminal body portions 742. The spacing D1, D2 and D3 is between differential pairs and serve to isolate the pairs. As the separation distance decreases, the likelihood of bothersome crosstalk rises.

It can be appreciated that the spacing D3 is about 40% less than the spacing D1 and hence the likelihood of crosstalk between the differential signal terminal pairs in the rows 140*a* and 140*b* increases. It has been determined that reducing the distance that the rows are separated by the distance D3 (which is driven by the fact that the connector provides two card receiving slots on the mating face) helps improve the performance of the connector. In this regard, the use of the angled portions of the terminal body portions is effective in reducing the horizontal components 742*b* of rows of adjacent differential signal terminal rows, rather than pure right angle configured terminals. With the angled portions, the horizontal components 742*b* of the signal terminals do not extend past the angled line "V", shown in FIG. 8, which runs diagonally between opposite corners of the terminal wafers. This terminal configuration thereby minimizes the length of the signal terminal horizontal components at the reduced spacing in an attempt to keep undesirable crosstalk down to a minimum. Preferably the horizontal length of the topmost signal terminal (e.g., the longest horizontal terminal length, "TTL") does not exceed about 60% of the length "WL" as shown in FIG. 8, which is the distance from the rear edge of the wafer to the forward edge of the wafer portion 124 separating a row of adjacent terminals.

In order to increase the electrical separation and minimize cross talk between adjacent rows of differential signal terminal pairs, the terminal assembly wafers are each preferably provided with a plurality of recesses, or channels, 900 that extend widthwise, or transversely through the connector between the horizontal extents of the signal terminal body portions 742 as best illustrated in FIG. 8. These channels locate pockets of air between the adjacent rows 140*a-d* of signal terminal pairs, the pockets of air serving to provide greater electrical separation, and are preferably located proximate to the intersection of the horizontal and angled components of the ground terminal body portions. By using distinct channels as opposed to continuous slots, the strength of the wafer 115 can be maintained and a desired spring force is maintained so the ground and signal terminal contact portions 723, 743 apply a certain contact force on an edge card 89 inserted therebetween.

Figure 10:
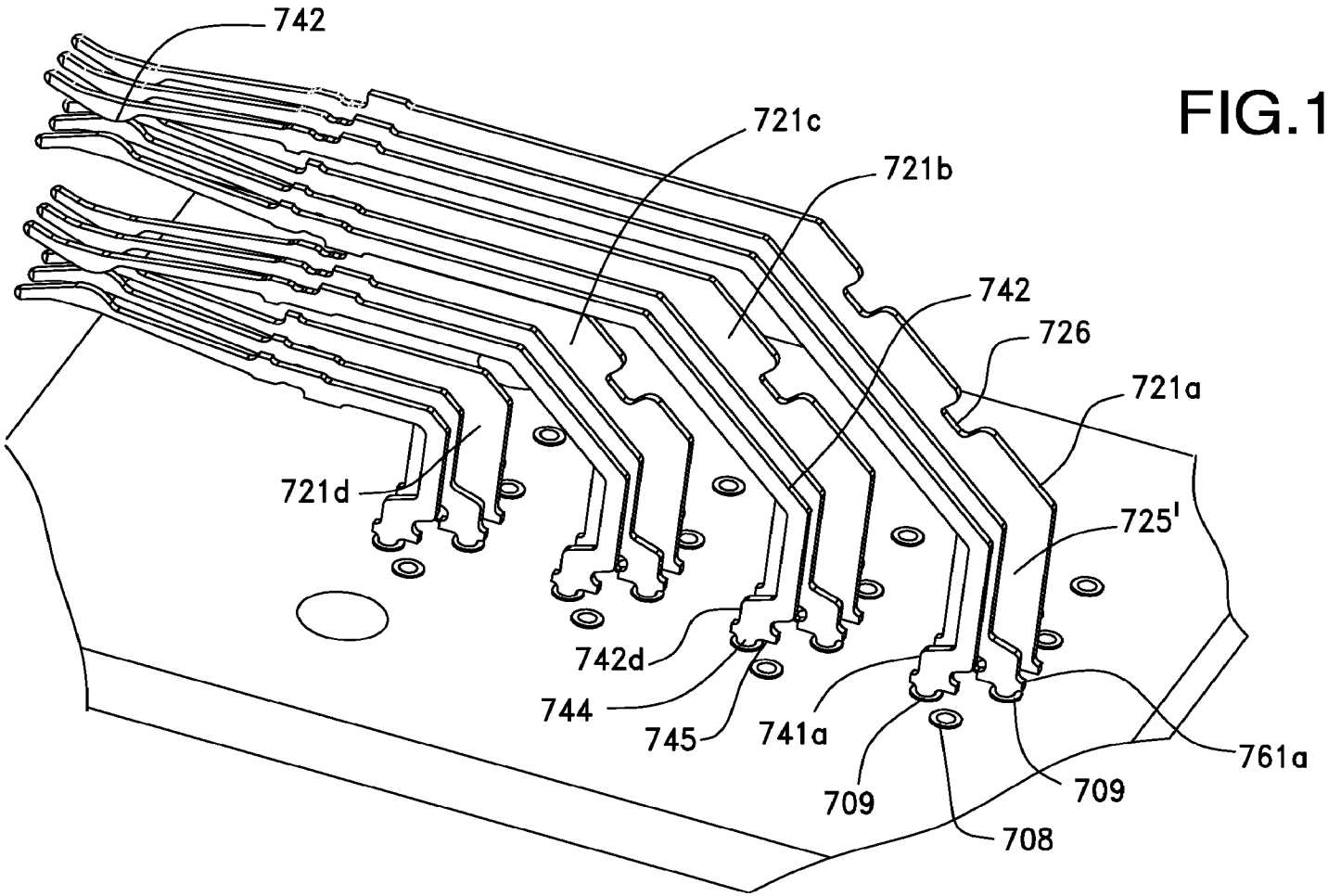
FIG. 10 illustrates another perspective view of the terminals depicted in FIG. 9 with one set of ground terminals removed.

It should be noted, as can be appreciated from FIG. 10, that adjacent signal terminals are positioned a first distance apart and that distance is maintained through the body of the terminal. The distance between the terminals increases, however, at a divergent body portion near the tails. More will be discussed regarding this point below.

As can be appreciated, the terminal configuration of the illustrated embodiments provides broad-side coupled differential signal terminals through the terminal insert wafers between the mating and mounting faces of the housing. Due to the desired small size of the connectors of the present invention, the tails 744 of the signal terminals 116*a* are preferably spread apart from each other, rather than aligned with each other and the ground terminal tail portions 722. This is done to accommodate a pattern of respective ground and signal vias 708, 709 in a circuit board 705 which provides enough space for necessary exit traces as well as for a secure mechanical connection. In addition, the use of adjacent, broadside coupled terminals (if the side-by-side arrangement was maintained) would result in via spacing that could weaken the circuit board in an undesirable manner. Therefore, it has been determined that spacing the vias 708, 709 apart helps provide sufficient space in which to drill the via patterns while maintaining mechanical integrity of the circuit board 705.

One issue with such a configuration is that the adjacent ground terminal typically is not wide enough to effectively shield the two spaced-apart terminals. One method to address shielding the terminals at the board interface is to use two or more vias and have a portion of the ground terminal couple multiple ground terminals together. Such a configuration, however, is less suitable for smaller, high-density connectors.

It has been discovered, however, that the ground terminals of the present invention can maintain their wider configuration all the way to the circuit board, as illustrated in FIGS. 9-14. In other words, the ground retains a width that is substantially wider than the signal terminal beyond an edge of the frame of the wafer. This allows for effective shielding up to the circuit board interface, while still allowing for a compact design, as discussed above. In an embodiment, the ground terminals may be configured so that they are at least as wide as the signal terminals over the entire path between the first side and the second side of the wafer.

Figure 11:
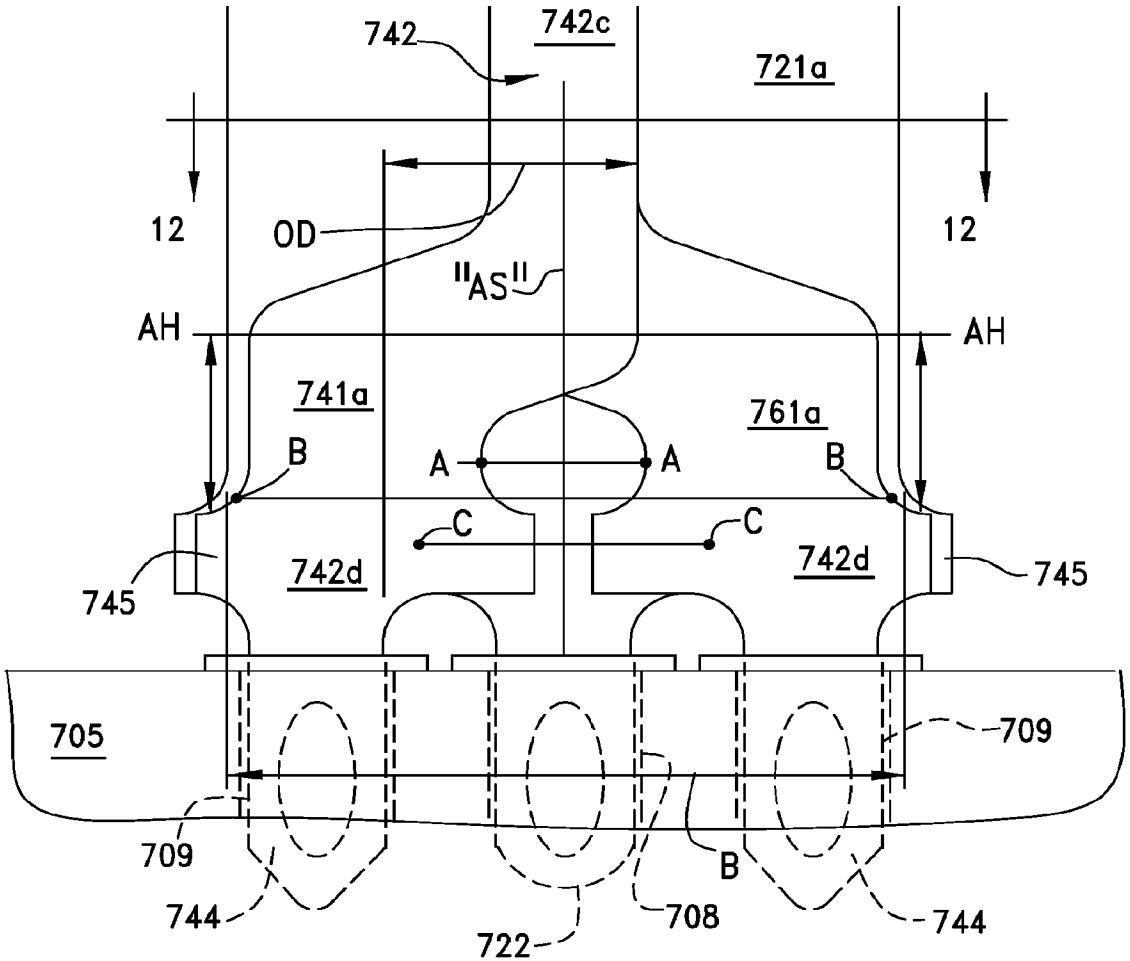
FIG. 11 illustrates an enlarged elevated side detail view of the terminals depicted in FIG. 10.
Figure 12:
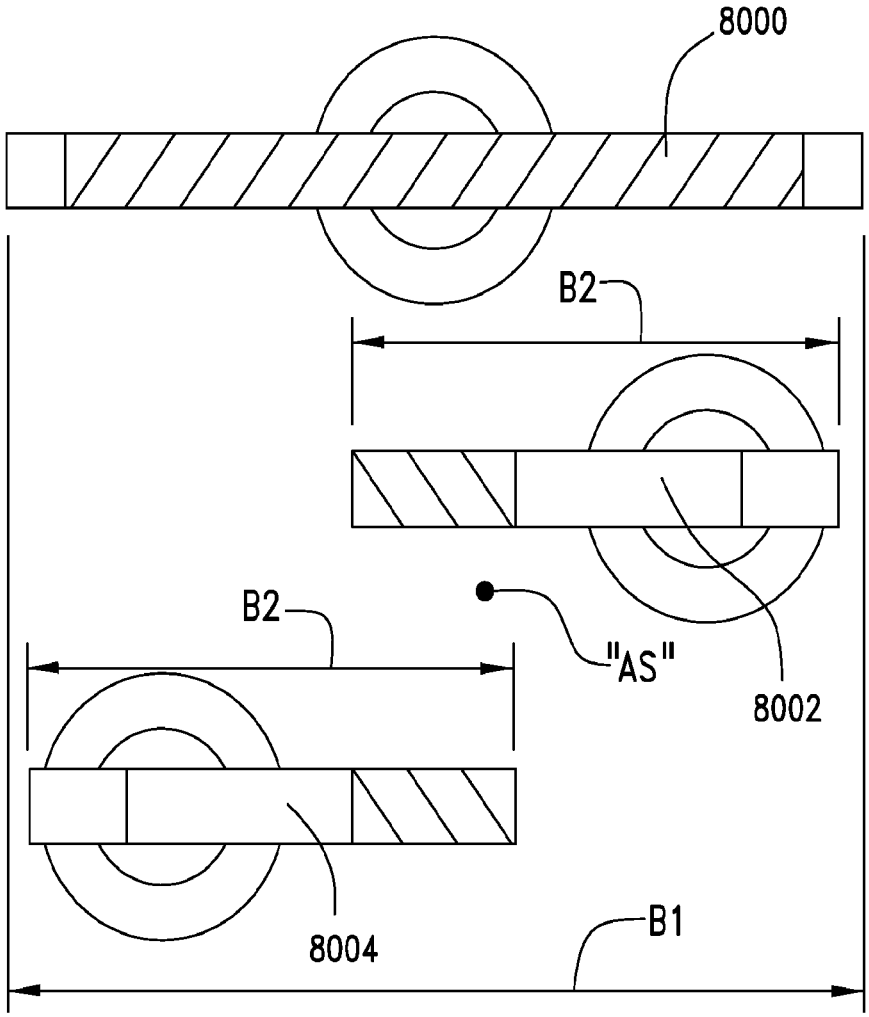
FIG. 12 illustrates a sectional view of FIG. 11, taken along lines 12-12 thereof.
Figure 13:
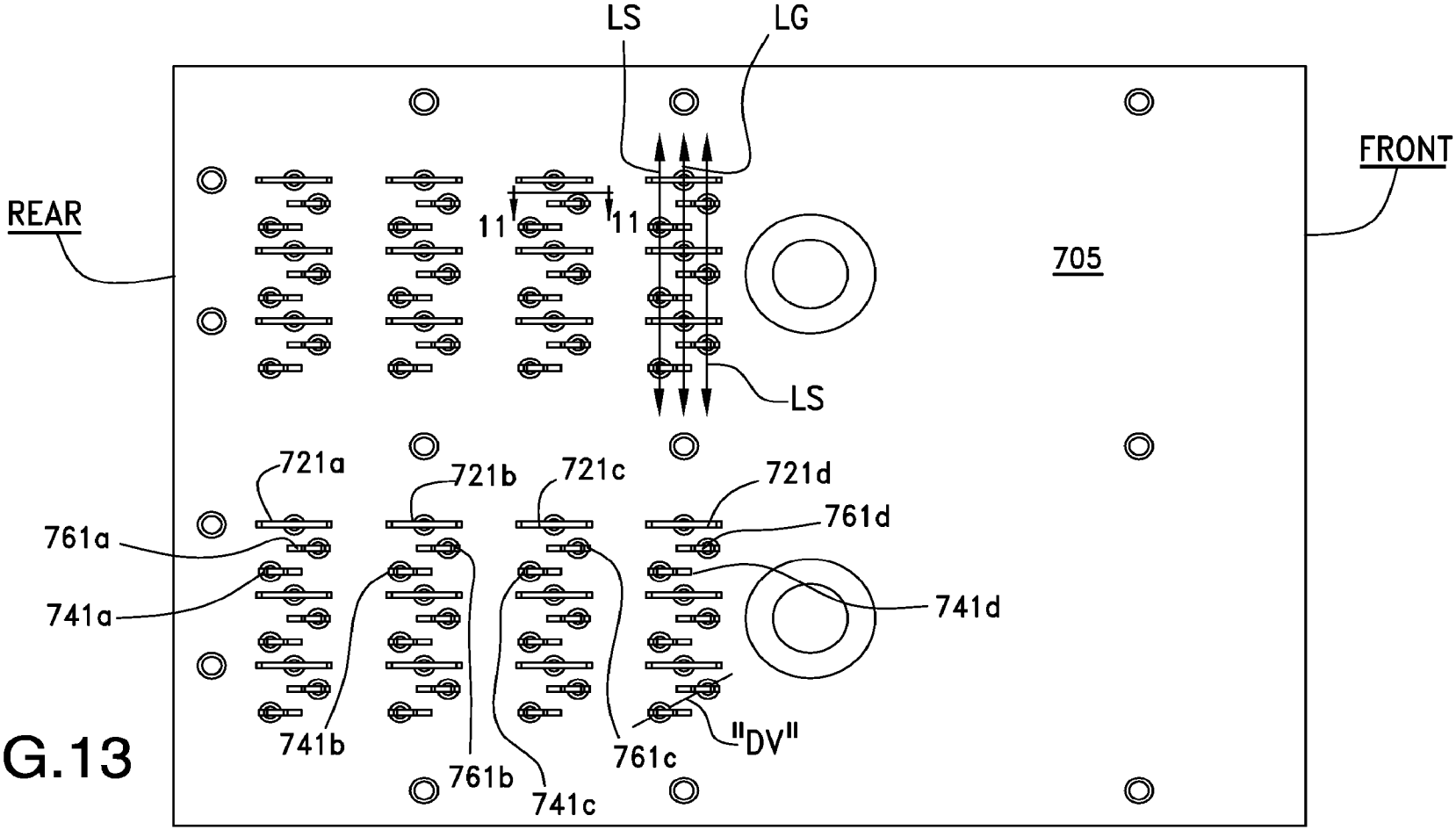
FIG. 13 illustrates a top plan view of an array of terminals removed from their supporting wafers and sectioned in the same manner as FIG. 12.
Figure 14:
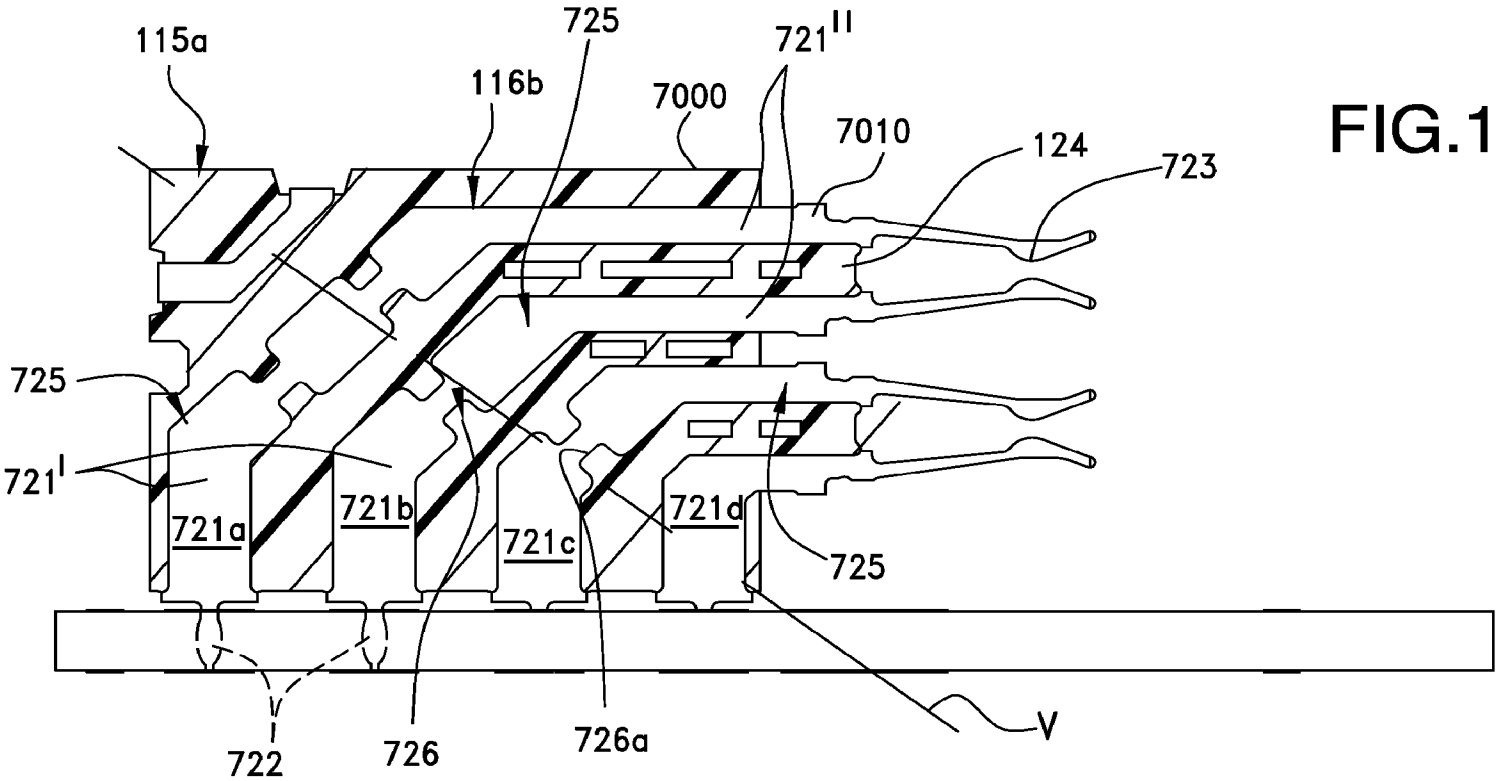
FIG. 14 is a sectional view taken through a ground terminal assembly of the connector of FIG. 1.

In an embodiment, the body portions of the signal terminals nearest their tail portions are specially configured to reduce skew. Turning to FIGS. 11 & 12, a wide ground terminal 721*a* is shown located next to a first (right) signal terminal 761*a* and a second (left) signal terminal 741*a*. The two signal terminals 761*a*, 741*a* are arranged in confronting pairs of terminals and are associated with at least one ground terminal 721*a*. The ground terminal body portion 725 is larger in size than either of the first and second signal terminals, while the dimensions of the signal terminals 761*a*, 741*a*, remain constant relatively from their contact portions 743 through their body portions 742 until proximate to the signal terminal tail portions 744, where the body portions diverge from their confronting relationship.

As shown in the enlarged detailed view of FIG. 11, the first and second signal terminal body portion vertical components 742*c* diverge longitudinally (e.g., from left to right or right to left in FIG. 13) from their confronting alignment along an axis of symmetry "AS" that extends down the centerline of the differential signal pair to form divergent body portions 742*d*. The first terminal 761*a* diverges toward the rear of the terminal assembly wafer (or to the right in FIG. 11), while the second signal terminal 741*a* diverges toward the front of the terminal assembly wafer (or to the left of FIG. 11). As the first and second signal terminals diverge longitudinally, they do so preferably symmetrically, i.e., in either the front to back or back to front directions, the spacing of the terminal edges stays the same for the signal pair. For example, the end points "A" and "B" shown in FIG. 11 will be spaced the same horizontal distance from the axis "AS", as well as any point on the interior of the terminal tails, such as "C". This symmetry not only extends along a vertical axis AS, but also it preferably extends from any horizontal axis, typically a longitudinal one (extending from front to back or back to front of the connector) chosen in the tail body portions, i.e., even the singulation terminal stubs 745 of the signal terminal body portions will be the same distance from any chosen horizontal datum, such as "AH". This bidirectional symmetry reduces the skew of the connectors. Additionally the boundaries B2 of the signal terminals fall within the boundary B1 of the side edges of the ground terminals, including their singulation portions.

As the signal terminal body portions transition from their vertical components 742*c* (which, as noted above, are a first distance apart) to their divergent portions 742*d*, the width of the signal terminals is increased. This helps modify capacitance between the signal terminals that make up the differential signal pair and helps compensate for the increased separation between the terminals. As can be appreciated, controlling the capacitance helps control the inductance and therefore can help reduce any impedance discontinuity. In an embodiment, the divergent portions (at approximately point A) are at least 30 percent larger and preferably are between about 45% to about 60% larger than the body portions 742 (at an angled component of the terminal body portion). It can be appreciated from the Figures that the signal terminal body portions have a relatively constant width, while the signal terminal divergent body portions have a variable width which changes as the terminals diverge from each other. Thus, the impedance and skew of the terminals may be controlled. In this manner, the mounting of the differential signal terminal tails is also facilitated in that the tail portions of the first and second signal terminals are spaced apart, or offset, from each other along their own common axis "LS"that lie on opposite sides of the ground terminal tail portion common axis "LG". Thus, a simple via pattern may be utilized and drilled into a supporting circuit board 705 in diagonal rows as shown best in FIG. 13. The vias for each differential signal terminal pair are arranged in diagonal rows adjacent each ground terminal as shown by the line "DV" in FIG. 13.

This pattern of terminals facilitates a repeating three wafer system that can provide a ground, signal, signal pattern that repeats and separates pairs of signal terminals with ground terminals. The adjacent signal terminals provide good differential coupling while the relatively wider ground terminals help provide electrical shielding between differential pairs in the same row. In other words, the wider grounds help ensure electrical separation between pairs of adjacent signal terminals.

Figure 15A:
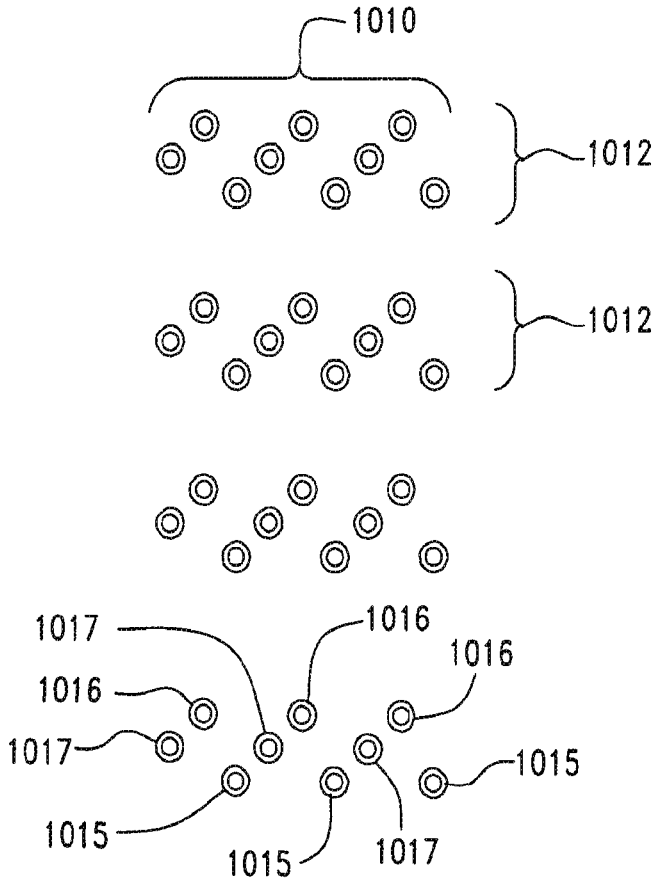
FIG. 15A illustrates an embodiment of a board with an exemplary via pattern.
Figure 15B:
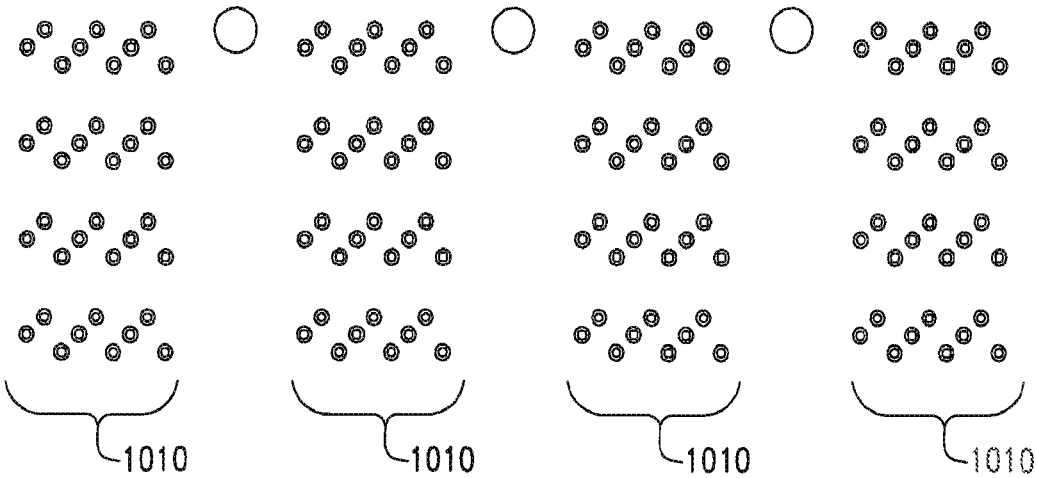
FIG. 15B illustrates an embodiment of board with a ganged array of the via pattern depicted in FIG. 15A.

Turning to FIGS. 15A-15B, a via pattern 1010 is depicted. The via pattern includes rows 1012 that that are configured to receive terminal tails associated with terminals that are provided on one side of a card-receiving slot. Thus, with four rows 1012, the via pattern 1010 is configured to correspond to a dual card-slot connector. As can be further appreciated, each row comprises a first via 1015, a second via 1016 and a third via 1017. The third via 1017 forms a line down a center of the row and the first and second via 1015, 1016 are spaced an equal distance on both sides of the line. In operation, the first and second via can be configured for use as signal vias for a differential pair and the third via provides a ground terminal. Because of the alignment of the signal vias and ground vias in the via pattern 1010, it is straightforward to route all the traces away from the vias. For a multi-layer board, it is relatively straightforward to route the traces away from the via pattern without substantially going substantially outside the boundary of the via pattern 1010. For example, the traces can be configured so that they only extend outside the via pattern 1010 on one side of the via pattern 1010.

As can be appreciated, therefore, the via pattern 1010 can be repeated for each connector and this repeatability enables a 1×4 ganged solution on a board with via patterns that are identical. With the depicted connector configuration, the board is configured to receive two single connectors (1×1) that are placed in two nonadjacent via patterns 1010. Or, alternatively, a 1×2 ganged connector can be placed in two adjacent via patterns and a 1×1 connector can be placed in a spaced apart via pattern. Or a 1×4 ganged connector can be mounted to the board. Thus a single board pattern is configured to receive at least three variations in connectors, including a 1×4 ganged connector, a 1×2 and a 1×1 connector, or 2 1×1 connectors. Therefore, unlike conventional via patterns where the via pattern is limited to a particular connector configuration, the depicted board configuration provides substantially more flexibility. As can be appreciated, this simplifies board manufacture as it becomes simple to provide four via patterns in a ganged array and then populate the board with a desired connector configuration (as is appropriate for the particular end product). Thus, the depicted design of the gnaged 1×4 via pattern 1010, while not required, can provide improvements in the usefulness of a circuit board.

It will be understood that there are numerous modifications of the illustrated embodiments described above which will be readily apparent to one of skill in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations. These modifications and/or combinations fall within the scope of knowledge of a person of ordinary skill in the art and unless otherwise noted are intended to be within the scope of the appended claims. It is noted, as is conventional, the use of a singular element in a claim is intended to cover one or more of such an element.

What is claimed is:

1. A connector, comprising:

a housing having a mating face and a mounting face;

a plurality of first wafers disposed within the housing, the first wafers each supporting a plurality of ground terminals, each ground terminal having a contact portion, a tail portion and an intervening body portion;

a plurality of second wafers disposed within the housing, each second wafer supporting a plurality of first signal terminals, each first signal terminal having a contact portion, a tail portion and an intervening body portion;

a plurality of third wafers disposed within the housing, each third wafer supporting a plurality of second signal terminals, each second signal terminal having a contact portion, a tail portion and an intervening body portion, wherein the second and third wafers are arranged to be positioned adjacent each other to form a pair of wafers with a first wafer position between each pair of wafers, the signal terminals in the pair of wafers being positioned in alignment so that the signal terminals in the adjacent wafer are, in operation, coupled together and the body portions of the coupled signal terminals are positioned a first distance apart, and wherein the signal terminals include divergent portions adjacent the tail portions, the divergent portions causing the signal terminals to be separated by a second distance that is greater than the first distance.

2. The connector of claim 1, wherein the body portions of the signal terminals have a first width and the divergent portions have second width, the second width being larger than the first width.

3. The connector of claim 2, wherein the second width is at least 30% larger than the first width.

4. The connector of claim 2, wherein the ground terminal body portion has third width which is greater than the second width.

5. The connector of claim 1, wherein the ground terminal tail portions are aligned along a first common axis and the first and second signal terminal tail portions are respectively aligned along second and third common axis, the second and third common axis being disposed on opposite sides of the first common axis.

6. The connector of claim 1, wherein the first and second divergent portions are symmetrical to each other around a first axis of symmetry.

7. The connector of claim 6, wherein the first and second signal terminal divergent body portions are symmetrical to each other around a second axis of symmetry.

8. The connector of claim 7, wherein the first and second axis of symmetry extend in different directions.

9. The connector of claim 6, wherein the first axis of symmetry extends in a longitudinal direction.

10. The connector of claim 1, wherein the ground terminal is wider than an overlap of a combination of the first and second signal terminal body portions.

11. The connector of claim 1, wherein the first, second and third wafers each includes a channel that extends a width of the respective wafer, each channel defining an air pocket between terminals in the same wafer.

12. The connector if claim 1, wherein the first and second signal terminal body portions have a horizontal component with a first length and the second and third wafer have a horizontal length, and the first length is not more than about 60% of the horizontal length.

13. A connector, comprising:

a housing, the housing having a mating face for engaging with an opposing connecting element, and a mounting face for mounting the connector to a circuit board;

a plurality of conductive signal and ground terminals supported in the housing, the signal terminals being arranged in sets of differential signal terminal pairs, each differential signal terminal pair having at least one ground terminal associated therewith, the signal terminals having contact portions that extend along the connector mating face and tail portions that extend along the connector mounting face and body portions that interconnect the signal terminal contact portions and terminal portions together, the signal terminal body portions further including divergent body portions interconnecting the signal terminal tail and body portions together; and the differential signal terminal pairs being arranged in side-by-side in order to effect broadside capacitive coupling therebetween from the signal terminal contact portions to the signal terminal divergent body portions, and wherein the signal terminal divergent body portions diverge longitudinally from the side-by-side order.

14. The connector of claim 13, wherein the signal terminal tail portions of each of the differential signal terminal pairs are longitudinally spaced apart from each other.

15. The connector of claim 14, where each of the ground terminals includes a contact portion aligned with the differential signal terminal pair contact portions, a tail portion and a body portion interconnecting the ground terminal contact and tail portions together, the ground terminal body portion confronting one of the signal terminal body portions.

16. The connector of claim 15, wherein the ground terminal body portion is wider than either of the differential signal terminal pair body portions.

17. The connector of claim 15, wherein the signal terminal tail portions of each of the differential signal terminal pair lie on opposite sides of the tail portion of an associated ground terminal.

18. The connector of claim 15, wherein the signal terminal tail portions are arranged in an imaginary diagonal line.

19. The connector of claim 13, wherein the signal terminal body portions have a first width and the signal terminal divergent body portions have a second width, the first width being a constant width and the second width being a variable width.

20. The connector of claim 13, wherein the first and second signal terminal divergent body portions are symmetrical with each other around a first axis of symmetry.

21. The connector of claim 20, wherein the first and second signal terminal divergent body portions are symmetrical with each other around a second axis of symmetry.

22. The connector of claim 13, wherein the first and second axis of symmetry extend in different directions.

* * * * *